US008254824B2

(12) United States Patent
Mizutani

(10) Patent No.: US 8,254,824 B2
(45) Date of Patent: Aug. 28, 2012

(54) RECORDING MEDIUM CONVEYING DEVICE AND IMAGE FORMING APPARATUS

(75) Inventor: Naoki Mizutani, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 550 days.

(21) Appl. No.: 12/498,809

(22) Filed: Jul. 7, 2009

(65) Prior Publication Data

US 2010/0067968 A1 Mar. 18, 2010

(30) Foreign Application Priority Data

Sep. 16, 2008 (JP) ..... 2008-235829
Apr. 24, 2009 (JP) ..... 2009-105775

(51) Int. Cl.
*G03G 21/16* (2006.01)

(52) U.S. Cl. ..... 399/392; 399/388

(58) Field of Classification Search ..... 399/392, 399/21, 388; 400/605, 607.2, 608.1, 624, 400/629, 630
See application file for complete search history.

(56) References Cited

U.S. PATENT DOCUMENTS 4,699,534 A * 10/1987 Asakura et al. ..... 400/568

FOREIGN PATENT DOCUMENTS

| | | | |
|---|---|---|---|
| JP | 60202037 A | * | 10/1985 |
| JP | 61106346 A | * | 5/1986 |
| JP | 03138231 A | * | 6/1991 |
| JP | 03223048 A | * | 10/1991 |
| JP | 06191106 A | * | 7/1994 |
| JP | 2000225763 A | * | 8/2000 |
| JP | 2005-024992 | | 1/2005 |
| JP | 2005-331760 | | 12/2005 |

* cited by examiner

*Primary Examiner* — Daniel J Colilla
(74) *Attorney, Agent, or Firm* — K&L Gates LLP

(57) ABSTRACT

A recording medium conveying device includes a first conveying unit that feeds a recording medium from a recording medium storage section to a registration roller, the recording medium storage section being located in a main body of an image forming apparatus; and a second conveying unit that feeds a recording medium from a bypass tray to the registration roller. A conveying roller of the first conveying unit and a conveying roller of the second conveying unit are driven by a driving unit.

8 Claims, 7 Drawing Sheets

【FIG.1】
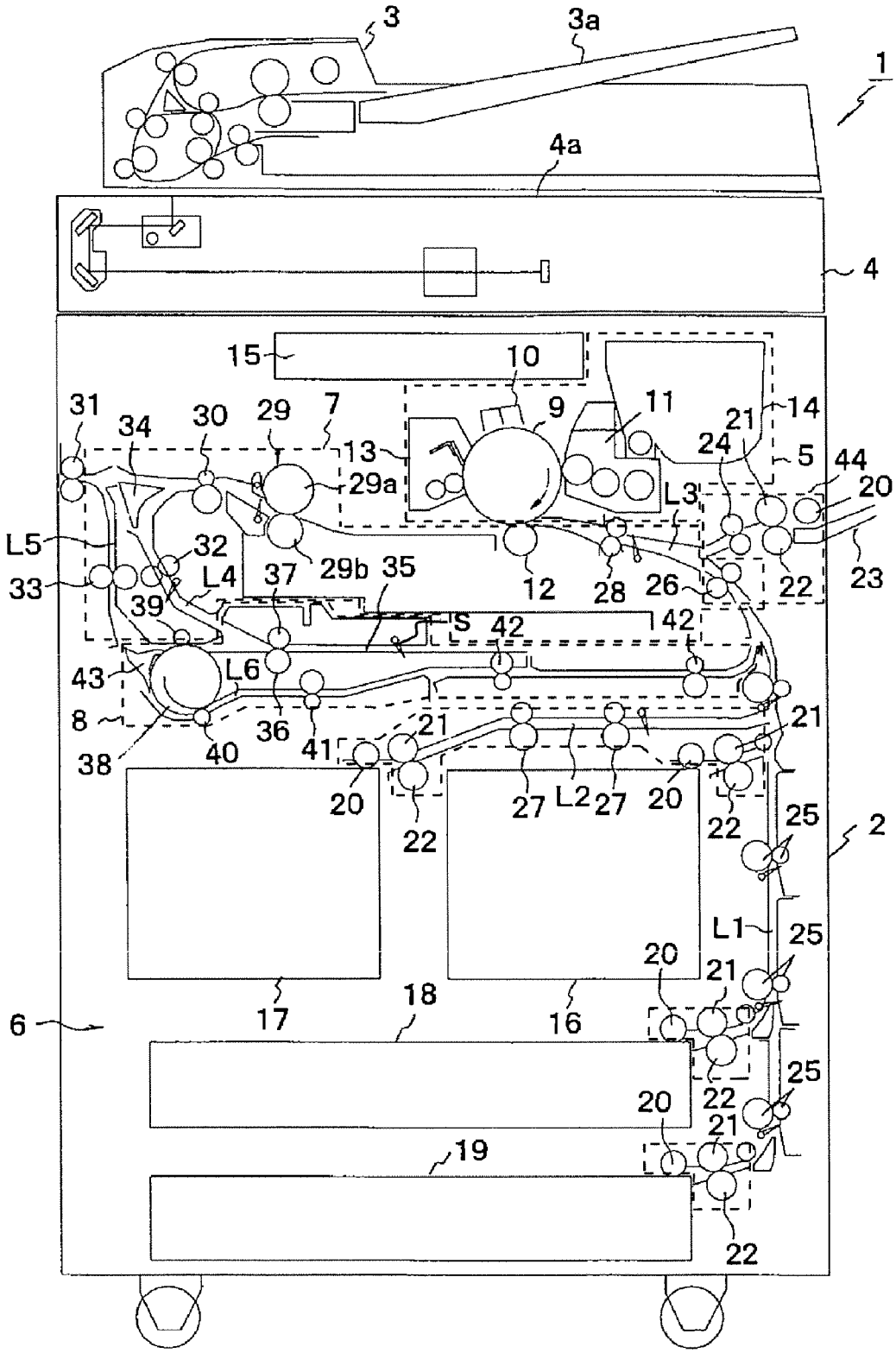

【FIG.2】
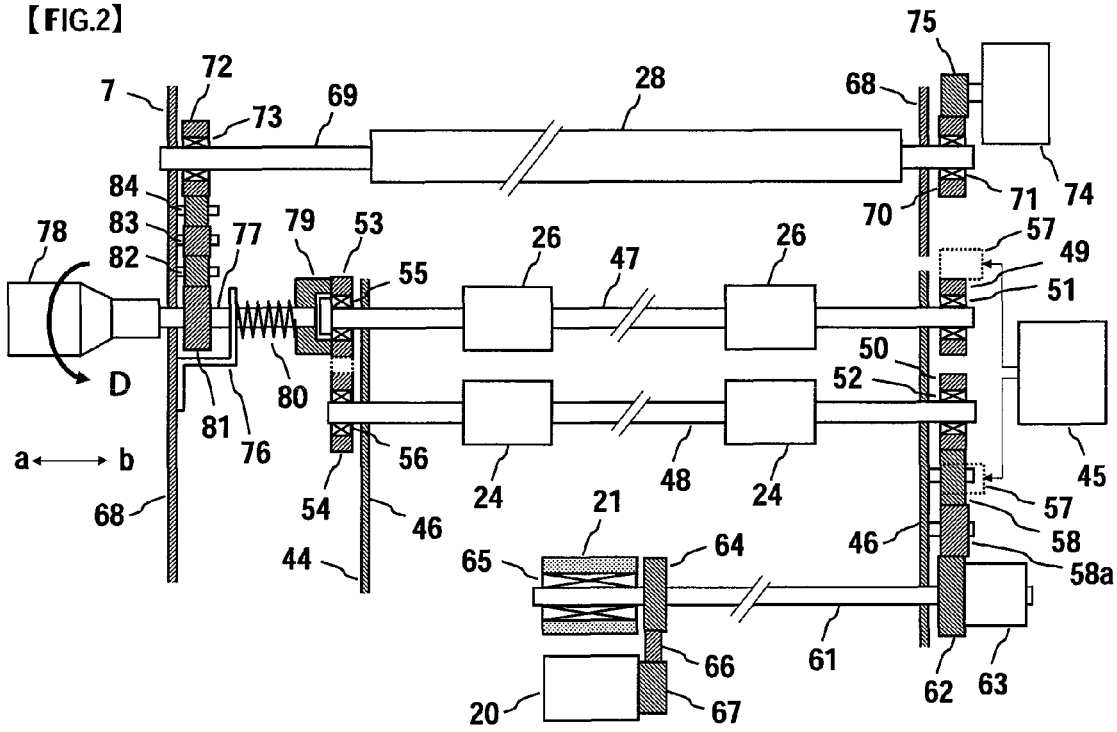

【FIG.3】
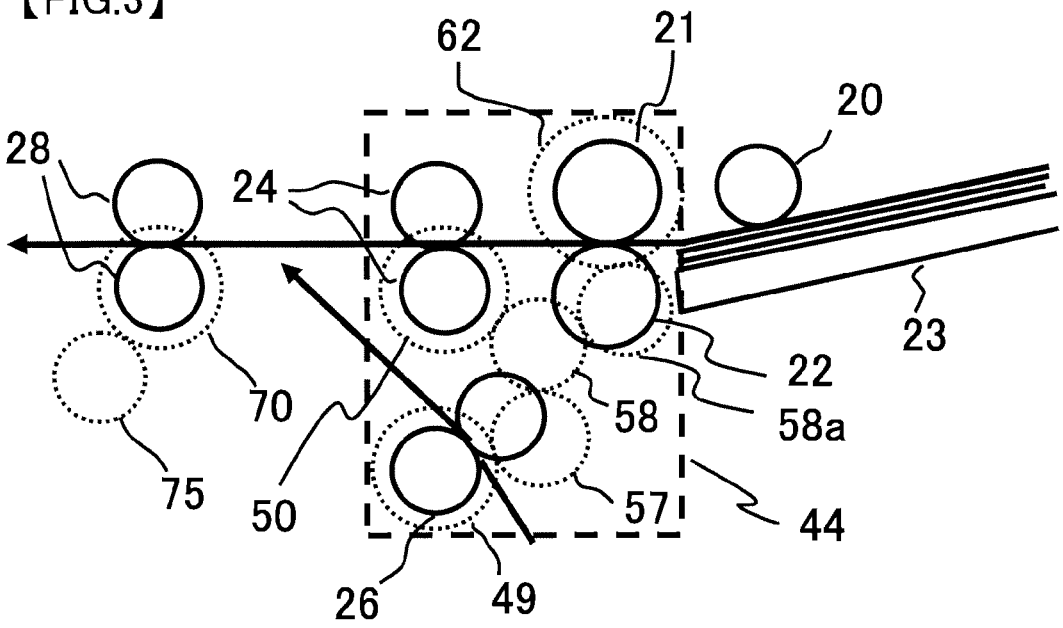
【FIG.4】
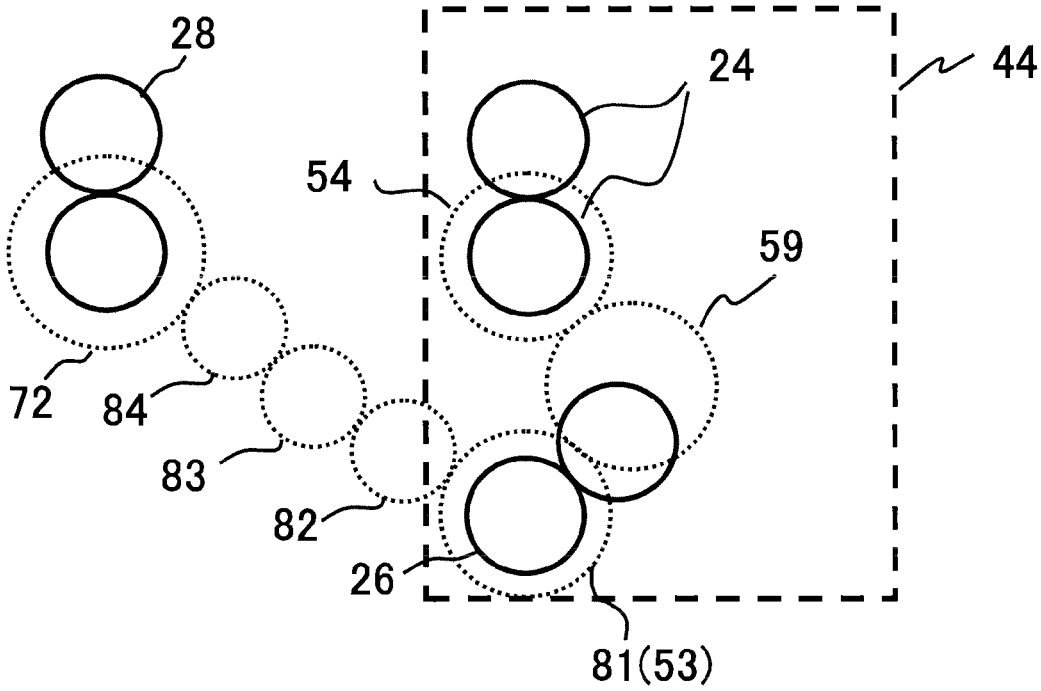

【FIG.5】
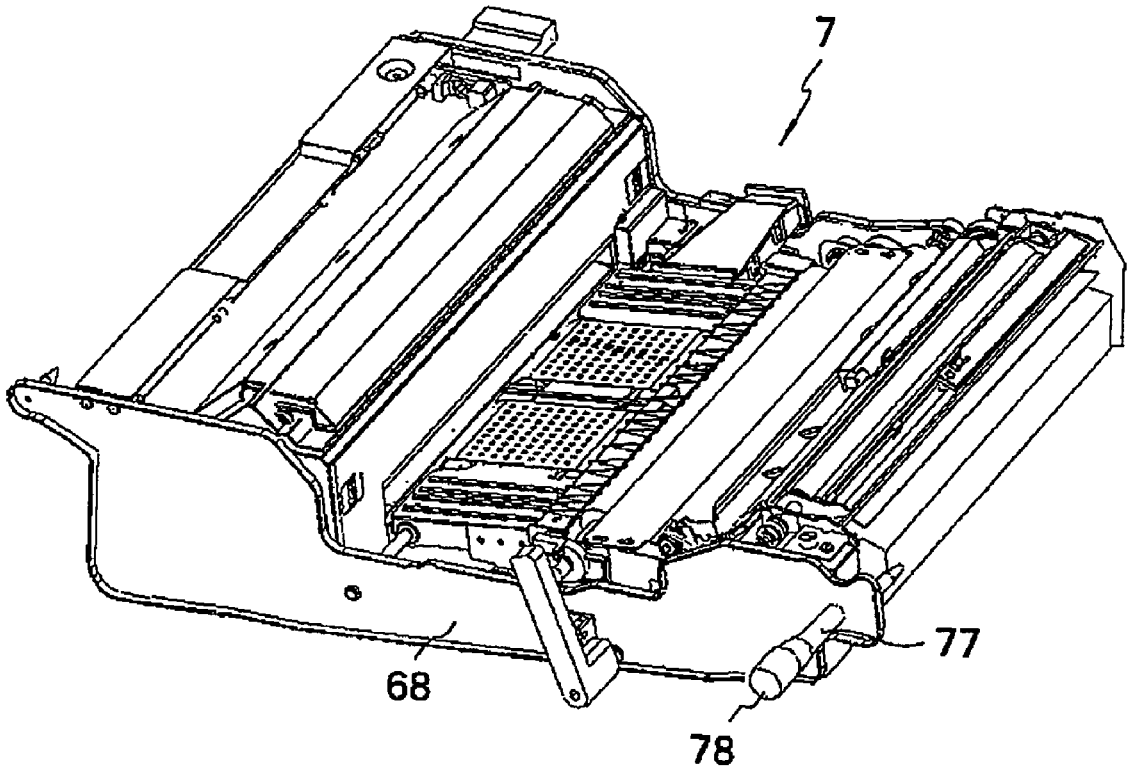

【FIG.6】
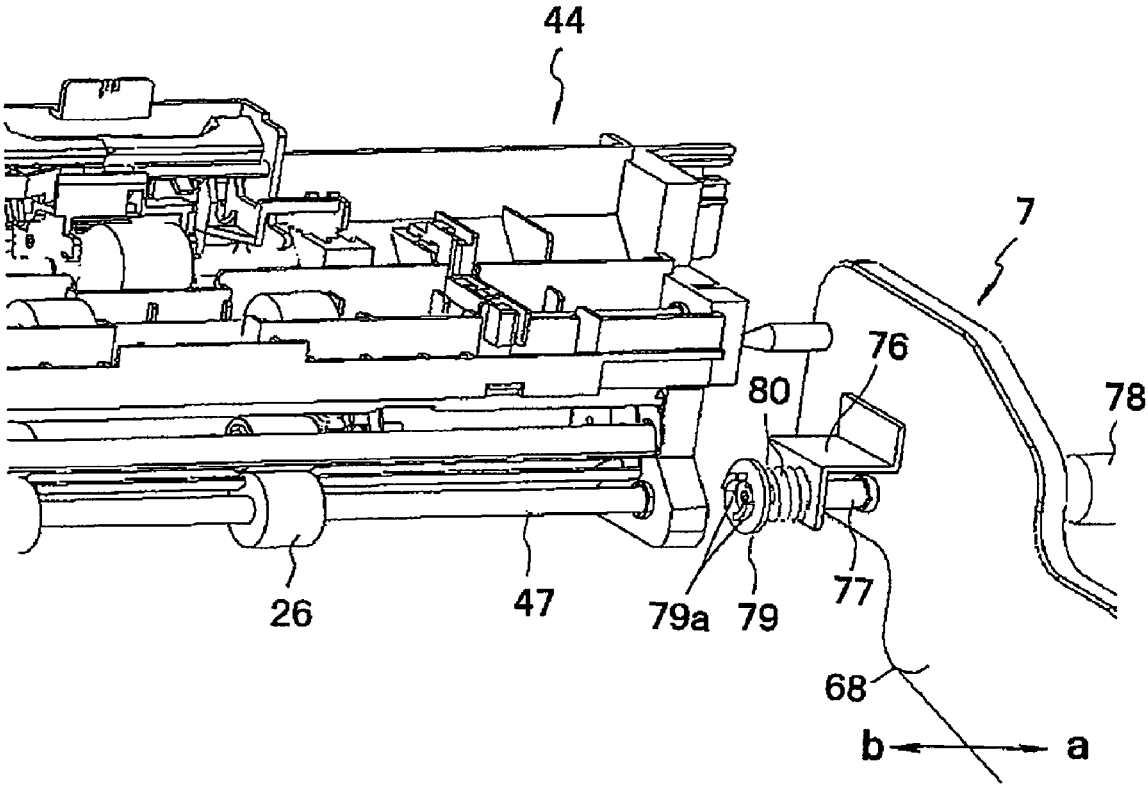

【FIG.7】
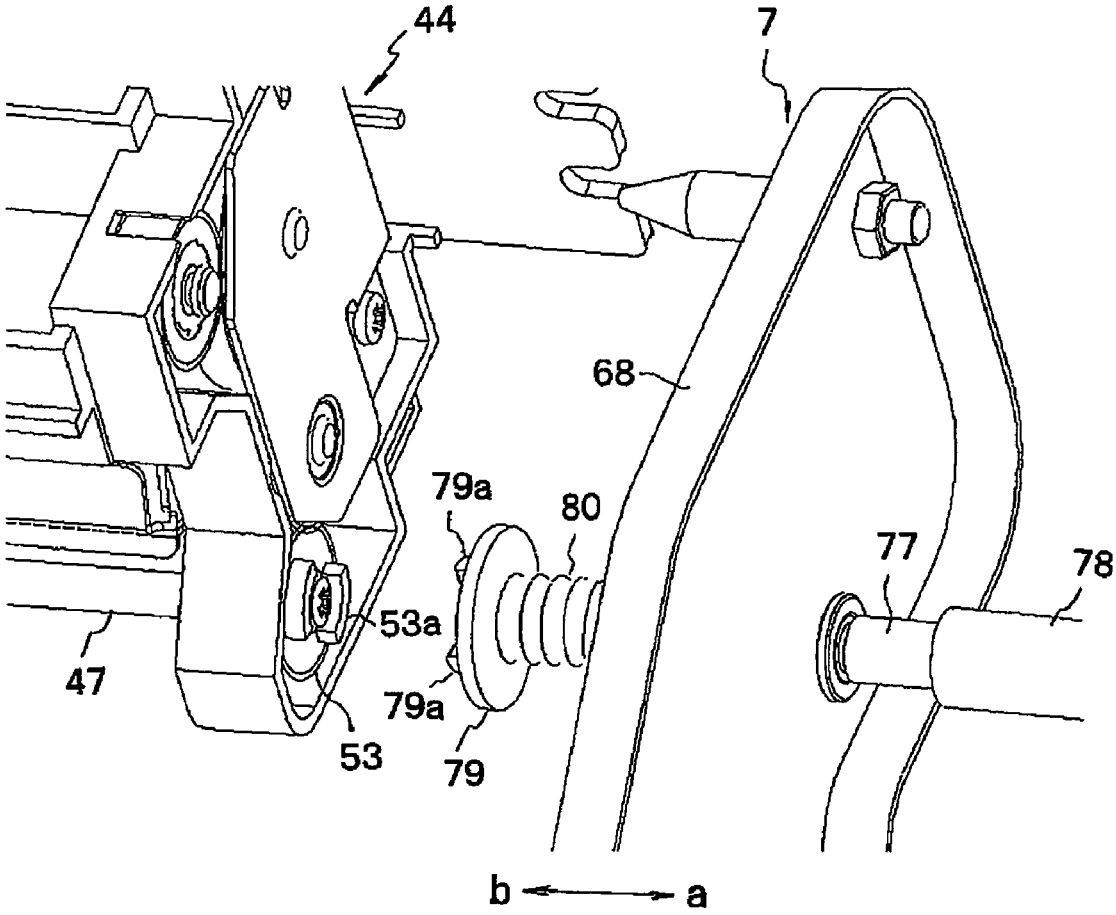

【FIG.8】
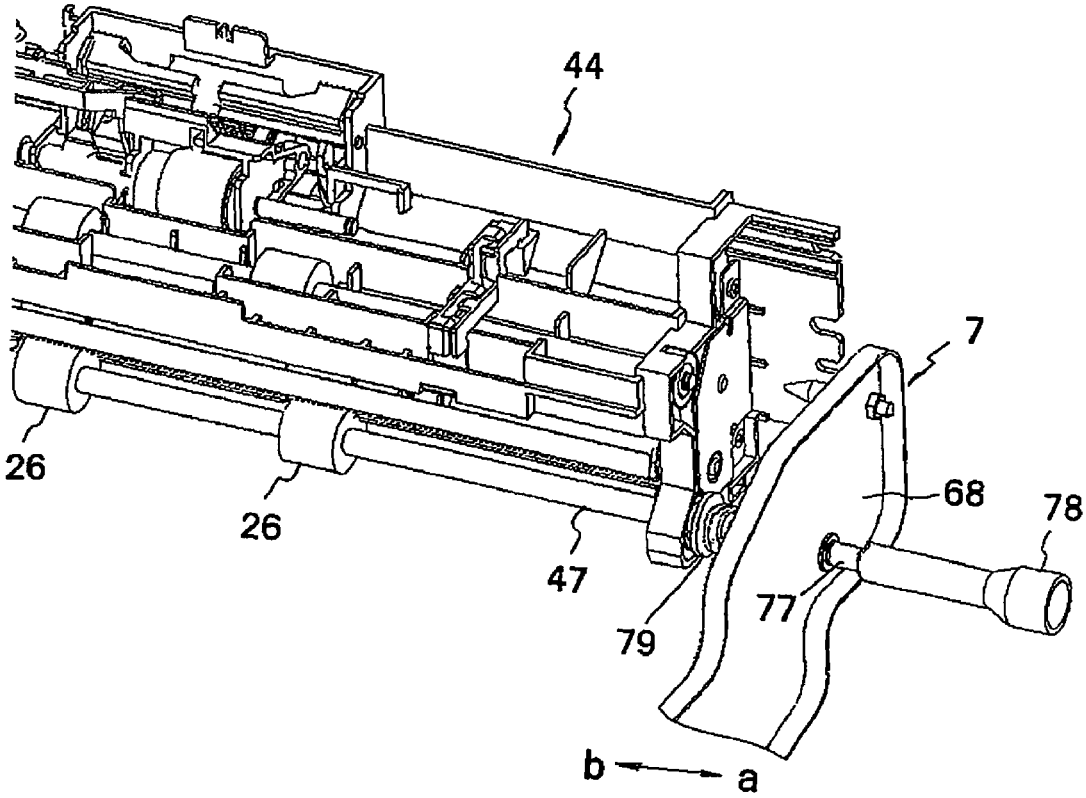

RECORDING MEDIUM CONVEYING DEVICE AND IMAGE FORMING APPARATUS

INCORPORATION BY REFERENCE

This application is based upon and claims the benefit of priority from the corresponding Japanese Patent Application No. 2008-235829, filed Sep. 16, 2008 and No. 2009-105775, filed Apr. 24, 2009, the entire contents of which are incorporated herein by reference.

BACKGROUND

1. Field of the Invention

The present invention relates to recording medium conveying devices and image forming apparatuses including recording medium conveying device.

2. Description of the Related Art

Image forming apparatuses include copying machines, printers, facsimiles (each of which forms an image onto a sheet of paper by an electrophotographic method), or multifunction apparatuses. A sheet of paper is an example of a recording medium. In an image forming apparatus, a first conveying member feeds recording media (sheets) from a recording medium storage section to registration rollers. The recording medium storage section is located in the interior of a main body, and stores the recording media. A second conveying member feeds recording media from a bypass tray to the registration rollers.

Accordingly, the sheets held in the recording medium storage section, such as a sheet-feed cassette in the main body, are conveyed one at a time to the registration rollers by a conveying roller. The sheets loaded in the bypass tray are also conveyed to the registration rollers by a different conveying roller. The sheets fed from the sheet storage section in the main body or the sheets fed from the bypass tray are conveyed by the registration rollers to a transfer nip portion, of an image forming section, at a suitable time to form an image at the image forming section. Then, a toner image formed on an image bearing member, such as a photosensitive drum, is transferred onto each of the sheets that is conveyed to the transfer nip portion.

In the image forming apparatus, the registration rollers, the conveying roller of the first conveying member, and the conveying roller of the conveying unit are independently driven by respective motors.

A transfer conveying unit including at least the registration rollers and transferring member is formed so as to be removably mounted to the main body. When a sheet jams in the transfer conveying unit, the following structure is used to remove the sheet. To remove the jammed sheet in the transfer conveying unit, a knob connected to the conveying roller or a pressing roller of a fixing device is manually turned, rotating the conveying roller or the pressing roller of the fixing device. By rotating the conveying roller or the pressing roller of the fixing device, the jammed sheet is removed from the interior of the image forming apparatus.

However, in image forming apparatuses, of the type wherein the registration rollers, the conveying roller of the first conveying member, and the conveying roller of the second conveying unit are independently driven by respective motors, the number of motors is increased, thereby making the structure of the image forming apparatus complicated, and increasing costs.

SUMMARY

A recording medium conveying device according to an embodiment of the invention includes a first conveying means for feeding a recording medium from a recording medium storage section to a registration roller, the recording medium storage section being located in a main body of an image forming apparatus; and a second conveying means for feeding a recording medium from a bypass tray to the registration roller, and a conveying roller of the first conveying means and the second conveying means are driven by a driving means. Image forming apparatuses as well as methods of forming images are also provided.

Additional features and advantages are described herein, and will be apparent from the following Detailed Description and the figures.

BRIEF DESCRIPTION OF THE FIGURES

In the accompanying drawings:

FIG. 1 is a sectional view of an image forming apparatus (a multifunction apparatus) according to an embodiment of the present invention;

FIG. 2 is a sectional view of the structure of a driving system of a second conveying unit and a transfer conveying unit of the image forming apparatus according to an embodiment of the present invention;

FIG. 3 is a side view of the structure of the driving system of the second conveying unit and the transfer conveying unit of the image forming apparatus according to an embodiment of the present invention;

FIG. 4 is a side view of the structure of a driving system of a knob;

FIG. 5 is a perspective view of the transfer conveying unit of the image forming apparatus according to an embodiment of the present invention;

FIG. 6 is a partial perspective view showing a situation wherein the knob is engaged with or disengaged from conveying rollers when the transfer conveying unit is removably mounted;

FIG. 7 is a partial perspective view showing a situation wherein the knob is engaged with or disengaged from the conveying rollers when the transfer conveying unit is removably mounted; and FIG. 8 is a partial perspective view showing a situation wherein the knob is engaged with or disengaged from the conveying rollers when the transfer conveying unit is removably mounted.

DETAILED DESCRIPTION

An embodiment of the present invention will hereinafter be described with reference to the attached drawings.

FIG. 1 is a sectional view of an image forming apparatus according to an embodiment of the present invention. The image forming apparatus 1 shown in FIG. 1 is a multifunction apparatus having a copying function, a printer function, and a facsimile function. The image forming apparatus 1 includes a main body 2, an automatic document conveying device 3, and a document reading device 4. An image forming section 5 is located at the upper portion in the main body 2. A recording medium storage section 6 is located at the lower portion in the main body 2. A transfer conveying unit 7 and a two-sided conveying unit 8 are located between the image forming section 5 and the recording medium storage section 6 in the main body 2.

The image forming section 5 forms an image by an electrophotographic method. The image forming section 5 includes a photosensitive drum 9 (functioning as an image bearing member), a charger 10 (functioning as charging means around the photosensitive drum 9), a developing device 11 (functioning as developing means), and a cleaning device 13 (functioning to remove the toner on the photosensitive drum 9). The image forming section 5 further includes a toner hopper 14 for supplying toner, which is a developing agent, to the developing device 11. A laser scanning unit (LSU) 15, functioning as an exposure means, is located beside the image forming section 5.

The recording medium storage section 6 includes four recording medium storage cassettes 16, 17, 18, and 19, which store a plurality of stacked recording media. The recording medium storage cassettes 16 to 19 are independently mountable to and removable from the main body 2. A pick-up roller 20, a feed roller 21, and a retard roller 22 are located near each of the recording medium storage cassettes 16 to 19. Each pick-up roller 20 removes a sheet, one at a time, from the corresponding recording medium storage cassettes 16 to 19. Each feed roller 21 and each retard roller 22 separates the removed sheets and sends them to a common conveying path L1. A retard roller 22, a feed roller 21, and a pick-up roller 20, are located near a bypass tray 23. The conveying path L1 is provided with pairs of conveying rollers 25. In addition, pairs of conveying rollers 27 are located in a conveying path L2 that extends substantially horizontally from the recording medium storage cassette 17 to the conveying path L1.

The transfer conveying unit 7 feeds a sheet sent from the recording medium storage section 6 in correspondence with the time at which a toner image is formed in the image forming section 5, and discharges the sheet having the image formed thereupon to a recording medium discharging section (not shown). A pair of registration rollers 28, a transfer roller 12 (functioning as transfer means), a fixing device 29, a pair of conveying rollers 30, and a pair of discharge rollers 31, all of which are located in a substantially horizontal conveying path L3 (connected to the conveying path L1), are successively located. Here, the fixing device 29 includes a fixing roller 29*a* and a pressing roller 29*b*, which rotate in a press-contact state.

The transfer conveying unit 7 is removably mounted to the main body 2. A U-shaped conveying path L4, which branches from the conveying path L3 and which extends towards the two-sided conveying unit 8, is located in the transfer conveying unit 7. A pair of conveying rollers 32 is provided in the conveying path L4. In the transfer conveying unit 7, a reverse conveying path L5, which is different from the conveying path L4, branches from the conveying path L3 and extends downward. A pair of conveying rollers 33 are provided in the reverse conveying path L5. A flapper 34 for switching the sheet feeding direction is rotatably provided at a branching portion of the conveying paths L4 and L3.

The two-sided conveying unit 8 reverses the front and back of the sheet such that the image is formed on the reverse side at the image forming section 5. The two-sided conveying unit 8 includes an intermediate tray 35 (connected to the conveying path L4 and the reverse conveying path L5) and a two-sided conveying path L6 (located below the intermediate tray 35). A reverse roller 36 (rotatable in both a forward and reverse direction) and a reverse roller 37 (which press-contacts and separates from the reverse roller 36) are provided at the intermediate tray 35.

A refeed roller 38, having a large diameter, is rotatably provided at the two-sided conveying unit 8. A roller 39 and a roller 40, having smaller diameters, rotatably contact the outer peripheral surface of the refeed roller 38. A one-way clutch (not shown) is connected to the refeed roller 38. A pair of sheet acceleration rollers 41 and a pair of conveying rollers 42 are located in the two-sided conveying path L6 that extends substantially horizontally from the refeed roller 38 to an entrance of the conveying path L3. A flapper 43 for switching the feed direction of a sheet that is drawn to the intermediate tray 35 once is rotatably provided near the refeed roller 38.

The sheet acceleration rollers 41 change the speed of a sheet that is fed in the two-sided conveying path L6. The sheet acceleration rollers 41 are driven by a variable-speed motor (not shown), such as a stepping motor. The timing of when the speed of the sheet acceleration rollers 41 is changed is a predetermined time after the trailing end of the sheet passes a sheet detecting sensor S towards the refeed roller 38. When the detection signal of the sheet detecting sensor S is sent to a controller (not shown), which is controlling means, the controller changes the speed of the sheet acceleration rollers 41 by controlling the variable-speed motor at a predetermined time.

Next, embodiment of the operation of forming an image in the image forming apparatus 1 with the above-described structure will be described.

When an operator presses a copy-start button, located at the operating section (not shown), of the image forming apparatus, a document placed on an document tray 3*a* of the automatic document conveying device 3 is automatically fed onto a contact glass 4*a* (which is an document reading section). Then, an image of the document is optically read by the document reading device 4. At the image forming section 5, the photosensitive drum 9 is rotationally driven in a direction indicated by an arrow shown in FIG. 1 (that is, in a clockwise direction) by driving means (not shown). The surface of the photosensitive drum 9 is uniformly charged to a predetermined electrical potential by the charger 10. Based on the image data transmitted from the document reading device 4, the photosensitive drum 9 is irradiated with laser light from the laser scanning unit 15, to form an electrostatic latent image on the photosensitive drum 9. Then, the electrostatic latent image formed on the photosensitive drum 9 is developed by toner from the developing device 11, to make it visible as a toner image.

When sheets are fed from a cassette, the sheets held in, for example, the recording medium storage cassette 16 of the recording medium storage section 6 are removed one by one, starting with the uppermost sheet by the pick-up roller 20. After the sheets are separated, one by one, by the feed roller 21 and the retard roller 22, the pairs of conveying rollers 25 and 26 feed the separated sheets in the conveying paths L1 and L3 and towards the pair of registration rollers 28. Then, at the registration rollers 28, after the sheets are set in a temporary standby state, the sheets are supplied to the image forming section 5 corresponding with the timing at which the toner image is formed on the photosensitive drum 9.

The sheet supplied to a transfer nip portion, formed between the photosensitive drum 9 and the transfer roller 12, is fed while the transfer roller 12 pushes it against the photosensitive drum 9. Due to the action of a transfer bias applied to the transfer roller 12, the toner image on the photosensitive drum 9 is transferred onto one surface (upper surface) of the sheet. The sheet having the transferred toner image is fed to the fixing device 29. When the sheet to which the toner image has been transferred passes through a fixing nip portion (formed between the fixing roller 29*a* and the pressing roller 29*b* of the fixing device 29), the sheet is heated and pressed, so that the toner image is fixed to the sheet. After transferring the toner image onto the sheet, any residual toner on the surface of the photosensitive drum 9 is removed by the cleaning device 13.

When a face-up discharge operation (FU discharge operation) is selected for the sheet to which the toner image is fixed to its surface by the fixing device 29, the sheet is fed through the conveying path L3 and towards the discharge rollers 31, and is discharged with its image surface facing upward to a discharge tray (recording medium discharging section) by the discharge rollers 31.

In contrast, when a face-down discharge operation (FD discharge operation) or a two-sided image formation mode is selected, the flapper 34 operates to switch the sheet feeding direction, so that the sheet that has passed by the fixing device 29 is fed to the two-sided conveying unit 8 through the conveying path L4.

At the two-sided conveying unit 8, the reverse roller 37 separated from the reverse roller 36 is in a standby state. When the sheet moves into the two-sided conveying unit 8 by a length that is equal to or greater than a prescribed length, the reverse roller 37 press-contacts the reverse roller 36. When the reverse roller 37 press-contacts the reverse roller 36, the reverse roller 36 rotates, so that the sheet is sent to the intermediate tray 35 in the direction in which it has been fed. When the sheet is drawn into the intermediate tray 35 by a length that is equal to or greater than a certain length, the direction of rotation of the reverse roller 36 is reversed. By reversing the feeding direction of the sheet, the sheet is fed to the reverse conveying path L5 or the two-sided conveying path L6.

That is, when the face-down discharge operation is selected, the flapper 43 switches the sheet feeding direction to the direction of the reverse conveying path L5. The sheet having its image surface facing downward is discharged to the discharge tray (not shown) by the discharge rollers 31.

When the two-sided image formation mode is selected, the flapper 43 switches the sheet feeding direction to the direction of the two-sided conveying path L6. The sheet having its image surface faced upward is fed to the two-sided conveying path L6 by the refeed roller 38, the pair of sheet acceleration rollers 41, and the pairs of conveying rollers 42. By feeding the sheet from the two-sided conveying path L6 to the conveying path L3, the front and back of the sheet is reversed, and the sheet having its image surface facing downward is fed to the registration rollers 28. Subsequently, a toner image is formed on the opposite surface of the sheet by a process that is similar to the above-described process. The toner image on the sheet is fixed by the fixing device 29, after which the sheet is discharged to the discharge tray (not shown) by the pair of discharge rollers 31. Accordingly, the images are formed on both sides of the sheet.

The foregoing description applies to the situation in which sheets are fed from cassettes. When sheets are manually fed, the sheets stacked upon each other in the bypass tray 23 are picked up one by one starting with the uppermost sheet by the pick-up roller 20, and are separated one by one by the feed roller 21 and the retard roller 22. The pair of conveying rollers 24 convey the separated sheets through the conveying path L3 and towards the pair of registration rollers 28. Thereafter, an image is formed on the sheet by a process that is similar to the above-described process.

In this embodiment, a second conveying unit 44 includes a pair of conveying rollers 26 at a first conveying means and the pair of conveying rollers 24 at a second conveying means, which are disposed upstream of the registration rollers 28. The second conveying unit 44 is fixed to the main body 2. The second conveying unit 44, the transfer conveying unit 7, the two-sided conveying unit 8, the conveying paths L1 to L5, and the two-sided conveying path L6 constitute the recording medium conveying device.

Next, an embodiment of the present invention will be described with reference to FIGS. 2 to 8.

FIG. 2 is a sectional plan view of the structure of a driving system of the second conveying unit and the transfer conveying unit. FIG. 3 is a side view of the structure of the driving system of the second conveying unit and the transfer conveying unit. FIG. 4 is a side view of the structure of a driving system of a knob. FIG. 5 is a perspective view of the transfer conveying unit. FIGS. 6 to 8 are each a partial perspective view showing a situation in which the knob is engaged with or disengaged from the conveying rollers when the transfer conveying unit is removably mounted.

In this embodiment, the conveying rollers 26 at a first conveying means side built in the second conveying unit 44 are driven by a driving motor 45 (see FIG. 2) functioning as driving means for driving the conveying rollers 24 at the second conveying means. That is, a feature of this embodiment is that the conveying rollers 24 and 26 are selectively driven by the forward or reverse rotation of the driving motor 45.

As shown in FIGS. 2 and 3, a roller shaft 47 and a roller shaft 48 are rotatably supported at the left and right side plates 46 of the second conveying unit 44. The pair of left and right conveying rollers 26 and the pair of left and right conveying rollers 24 are located at the roller shaft 47 and the roller shaft 48, respectively. Gears 49 and 50 are mounted to the respective roller shafts 47 and 48 at one end in an axial direction through one-way clutches 51 and 52, respectively. The one-way clutches 51 and 52 input the rotation of the gears 49 and 50 in a prescribed direction to the roller shafts 47 and 48, respectively. In contrast, the one-way clutches 51 and 52 do not input the rotation of the gears 49 and 50 in a direction opposite to the prescribed direction to the roller shafts 47 and 48, respectively. A coupling gear 53 and a driven gear 54 are mounted to the respective roller shafts 47 and 48 at the other end in the axial direction through one-way clutches 55 and 56, respectively. A motor gear 57, disposed at an output shaft end of the driving motor 45, engages the gear 49 and engages the gear 50 through an idle gear 58. As shown in FIG. 4, the coupling gear 53 and the driven gear 54 are connected to each other through an idle gear 59. As shown in FIG. 7, an arc-shaped projection 53*a* is integrally formed with the coupling gear 53.

Further, as shown in FIG. 2, a roller shaft 61 is rotatably supported at the left and right side plates 46 of the second conveying unit 44. A gear 62 and an electromagnetic clutch 63 are mounted to one end in an axial direction of the roller shaft 61. The electromagnetic clutch 63 is used for allowing or not allowing rotation of the gear 62 to be inputted to the roller shaft 61 as required. A gear 64 is mounted to the other end of the roller shaft 61 in the axial direction. The feed roller 21 is mounted to the other end of the roller shaft 61 in the axial direction through a one-way clutch 65. The gear 62 engages the idle gear 58*a* through the idle gear 58, and the gear 64 engages a gear 67 (disposed at the pick-up roller 20) through the idle gear 66.

A roller shaft 69 of each registration roller 28 is rotatably supported at the left and right side plates 68 of the transfer conveying unit 7. A gear 70 is mounted to one end in an axial direction of the roller shaft 69 through a one-way clutch 71. A gear 72 is mounted to the other end in the axial direction of the roller shaft 69 through a one-way clutch 73. A motor gear 75, located at an output shaft end of a driving motor 74, for rotationally driving the registration rollers 28, engages the gear 70.

As shown in FIGS. 2 and 5 to 8, a rotating shaft 77 is rotatably supported by one of the side plates 68 of the transfer conveying unit 7 and a bracket 76 disposed inwardly of the one of the side plates 68. The rotating shaft 77 is located coaxially with the roller shaft 47. A knob 78 is located at a side-plate-68-side end of the rotating shaft 77. A coupling member 79 is supported at the other end of the rotating shaft 77 so as to be slidable in an axial direction. As shown in FIG. 7, a projection 79*a* that engages the projection 53*a* of the coupling gear 53 is formed at the coupling member 79. By mounting the transfer conveying unit 7 to or removing it from the main body 2, the projection 79*a* of the coupling member 79 is engaged with or disengaged from the projection 53*a* of the coupling gear 53. That is, the coupling member 79 and the coupling gear 53 are connected to or disconnected from each other. The coupling member 79 and the coupling gear 53 constitute engaging means for engaging the knob 78 to and disengaging it from the roller shaft 47.

A spring 80, that serves as an elastic member, is compressed and located between the coupling member 79 and the bracket 76. The spring 80 urges the coupling member 79 towards the side of the coupling gear 53.

As shown in FIGS. 2 and 4, a gear 81 is located at the rotating shaft 77. The gear 81 engages the gear 72, located at the other side in the axial direction of the roller shaft 69, through three idle gears 82, 83, and 84.

When sheets are fed using cassettes, the driving motor 45 is rotated forwardly. By transmitting the rotation of the driving motor 45 to the roller shaft 47 through the motor gear 57, the gear 49, and the one-way clutch 51 (that is in the on state), the roller shaft 47 and the conveying rollers 26, located at the roller shaft 47, are rotationally driven. By rotationally driving the conveying rollers 26, a sheet that is supplied from any one of the recording medium storage cassettes 16 to 19 is fed to the pair of registration rollers 28. Then, when the driving motor 74 is driven at a proper timing, its rotation is transmitted to the roller shaft 69 through the one-way clutch 71 and the gear 70. Therefore, the registration rollers 28 are rotationally driven, so that the sheet that stops at the registration rollers 28 and that is in a temporary standby condition is fed to the transfer nip portion. Then, a toner image is transferred onto the sheet. At this time, the rotation of the driving motor 45 is transmitted to the gear 50 through the motor gear 57 and the idle gear 58. However, since the one-way clutch 52 is in an off state, the gear 50 rotates idly. Since its rotation is not transmitted to the roller shaft 48 and the conveying rollers 24, the conveying rollers 24 are stationary. In addition, since the one-way clutch 55 is in an off state, the rotation of the roller shaft 47 is not transmitted to the rotating shaft 77 through the coupling gear 53 and the coupling member 79. Further, since the one-way clutch 73 is in the off state, the rotation of the roller shaft 69 at each of the registration rollers 28 is not transmitted to the rotating shaft 77 and the knob 78 through the gear 72, the idle gears 84, 83, and 82, and the gear 81. Therefore, the rotating shaft 77 and the knob 78 are not rotated.

When sheets are manually fed from the bypass tray, the driving motor 45 is rotated in the reverse direction. Here, when the driving motor 45 is rotated in the reverse direction, the one-way clutch 51 is set in an off state, and the one-way clutch 52 is set in an on state. Therefore, since the gear 49 rotates idly, the rotation of the driving motor 45 is not transmitted to the roller shaft 47 and the conveying rollers 26. Therefore, when the driving motor 45 is rotated in the reverse direction, the state when of the roller shaft 47 and the conveying rollers 26 are stopped is maintained. In contrast, the rotation of the driving motor 45 is transmitted to the roller shaft 48 through the motor gear 57, the idle gear 58, the gear 50, and the one-way clutch 52 in the on state. Therefore, since the conveying rollers 24 are rotated, a sheet fed from the bypass tray 23 is fed to the registration rollers 28 by the conveying rollers 24. Even when a sheet is manually fed, the driving motor 74 is driven at a proper timing, and the rotation of the driving motor 74 is transmitted to the roller shaft 69 through the one-way clutch 71 and the gear 70. Therefore, since the registration rollers 28 rotate, the sheet that stops at the registration rollers 28 and that is in a temporary standby state is fed to the transfer nip portion, so that a toner image is transferred onto the sheet. When sheets are manually fed, the one-way clutch 56 and the one-way clutch 73 are in the off state, so that the knob 78 does not rotate by the rotations of the conveying rollers 24 and the registration rollers 28.

When, in manually feeding sheets, the driving motor 45 is rotated in the reverse direction, its rotation is transmitted to the gear 62 through the idle gears 58 and 58*a*. Here, when the electromagnetic clutch 63 is turned on, the rotation of the gear 62 is transmitted to the feed roller 21 through the roller shaft 61 and the one-way clutch 65 in the on state, thereby causing the feed roller 21 to rotate in the sheet-feed direction. At the same time, the rotation of the roller shaft 61 is transmitted to the pick-up roller 20 through the gears 64, 66, and 67, thereby causing the pick-up roller 20 to rotate in the sheet-feed direction. In this way, when the pick-up roller 20 and the feed roller 21 rotate, the sheets in the bypass tray 23 are picked up, one by one, separated from each other, and are supplied to the conveying rollers 24. Thereafter, when the electromagnetic clutch 63 is turned off, the pick-up roller 20 and the feed roller 21 rotate so as to follow the sheet.

Next, when a sheet that is being fed jams in the conveying rollers 24, the conveying rollers 26, or the registration rollers 28, if the knob 78 is manually turned in a predetermined direction (that is, in a direction opposite to the direction of rotation of the roller shaft 47 or the direction of solid arrow D in FIG. 2), the rotation of the knob 78 is transmitted to the roller shaft 47 through the rotating shaft 77, the coupling member 79 and the coupling gear 53 that are engaged with each other, and the one-way clutch 55 in the on state. When the controller (not shown) detects through detecting means (not shown) that the sheet jams, the controller stops the driving motor 45 and the driving motor 74. Therefore, by manually turning the knob 78, the conveying rollers 26 rotate in a direction opposite to that in which the sheet is being fed. The rotation of the coupling gear 53 is transmitted to the roller shaft 48 through the idle gear 59, the gear 54, and the one-way clutch 56 in the on state. Therefore, by manually turning the knob 78, the conveying rollers 24 are rotated in a direction opposite to that when the sheet is being fed. Since the conveying rollers 26 and the conveying rollers 24 rotate, the jammed sheet in the conveying rollers 24 or the conveying rollers 26 is fed in a direction opposite to that when the sheet is being fed, and is easily removed. At this time, since the one-way clutches 51 and 52 are in the off state, the load of the driving motor 45 is not applied to the knob 78 when the knob 78 is turned. Therefore, the knob 78 can be easily turned using a small force.

The rotation of the knob 78 is transmitted to the roller shaft 69 through the idle gears 82, 83, and 84, the gear 72, and the one-way clutch 73 in the on state. Therefore, since the registration rollers 28 rotate, the jammed sheet in the registration rollers 28 is fed and easily removed. At this time, since the one-way clutch 71 is in the off state, the load of the driving motor 74 is not applied to the knob 78 when the knob 78 is turned. Therefore, the knob 78 can be easily turned using a small force.

The transfer conveying unit 7 may be removed from the main body 2 in the direction of arrow a shown in FIGS. 6 and 7 or may be removably mounted to the main body 2 in the direction of arrow b shown in FIGS. 6 and 7. As shown in FIGS. 2 and 8, when the transfer conveying unit 7 is removably mounted in the main body 2, the coupling member 79, provided at one end of the rotating shaft 77 at the knob 78 provided at the transfer conveying unit 7, engages the coupling gear 53, located at an end of the roller shaft 47 at the second conveying unit 44. Therefore, the knob 78 and the roller shaft 47 are connected to each other. When a sheet that is being fed jams, the jammed sheet can be easily removed by manually turning the knob 78 as mentioned above.

When the transfer conveying unit 7 is removed from the main body 2 in the direction of arrow a in FIGS. 6 and 7 for, for example, maintenance, the coupling member 79 and the coupling gear 53 are disengaged from each other. Therefore, since the knob 78 at the transfer conveying unit 7 is removed along with the transfer conveying unit 7, the knob 78 does not hinder the removal of the transfer conveying unit 7.

When the removed transfer conveying unit 7 is removably mounted to the main body 2, the transfer conveying unit 7 is assembled to the main body 2 in the direction of arrow b shown in FIGS. 6 and 7. This causes the coupling member 79, provided at an end of the rotating shaft 77 at the knob 78, to engage the coupling gear 53, located at an end of the roller shaft 47 at the second conveying unit 44. Therefore, as shown in FIGS. 2 and 8, the knob 78 and the roller shaft 47 at the second conveying unit 44 are connected to each other. When a sheet that is being fed jams, the jammed sheet can be easily removed by manually turning the knob 78 as mentioned above. In this embodiment, since the coupling member 79 is urged in the direction of the coupling gear 53 by the spring 80, force that is generated when the coupling member 79 is engaged with or disengaged from the coupling gear 53 by mounting the transfer conveying unit 7 to or removing it from the main body 2 is effectively absorbed by elastic deformation of the spring 80. Therefore, breakage of the coupling member 79 and the coupling gear 53 is prevented from occurring.

As mentioned above, in the image forming apparatus 1 according to this embodiment, the conveying rollers 26 at the first conveying means, located upstream from the registration rollers 28, are driven by the driving motor 45 that drives the conveying rollers 24 at the second conveying means, and the conveying rollers 24 and 26 are selectively driven based on the forward or reverse rotation of the driving motor 45. Therefore, it is possible to reduce the number of driving motors, to simplify the structure and reduce costs.

When a sheet being fed by the conveying rollers 24 and 26 jams, by rotating the conveying rollers 24 and 26 (provided at the second conveying unit 44) by manually turning the knob 78 (provided at the transfer conveying unit 7), the jammed sheet can be easily removed. Since the knob 78 is located at the transfer conveying unit 7, the side plates 68 of the transfer conveying unit 7 only need to be provided with small holes allowing the small-diameter rotating shaft 77 at the knob member 78 to pass therethrough, so that a reduction in strength of the side plates 68 due to forming the holes is minimized.

Further, in this embodiment, even if the knob 78 is provided at the transfer conveying unit 7, when the transfer conveying unit 7 is removably mounted to the main body 2, the knob 78 is engaged with or is disengaged from the conveying rollers 26 (roller shaft 47) by the coupling member 79 and the coupling gear 53 (which are engaging means). This does not cause the knob 78 to hinder the mounting or removal of the transfer conveying unit 7 to or from the main body 2. When a sheet jams, the jammed sheet can be easily removed by manually turning the knob 78 connected to the roller shaft 47 of the rollers 26.

In this embodiment, since the registration rollers 28 rotate in response to the rotation of the knob 78, even if a sheet jams in the registration rollers 28, the jammed sheet can be easily removed by manually turning the knob 78.

Although, in the embodiment, the present invention is described using a multifunction apparatus as an example, the prevent invention is applicable to, for example, a single apparatus, such as a copying machine, a printer, or a facsimile.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A recording medium conveying device comprising:

a first conveying means configured to feed a recording medium from a recording medium storage section to a registration roller, the recording medium storage section being located in a main body of an image forming apparatus, the first conveying means including a first conveying roller;

a second conveying means configured to feed the recording medium from a bypass tray to the registration roller, the second conveying means including a second conveying roller; and a transfer conveying unit including at least one side plate the registration roller, transfer means, and a knob for manually rotating the first conveying roller and the second conveying roller, the registration roller, transfer means and knob being supported by the at least one side plate;

wherein the first conveying roller and the second conveying roller are configured to be driven by a same driving means;

wherein the transfer conveying unit is capable of being removably mounted to the main body of the image forming apparatus by moving the at least one side plate out of the image forming apparatus; and wherein the first conveying means and the second conveying means are configured to remain fixed to the main body of the image forming apparatus in a case where the transfer conveying unit is removed from the main body of the image forming apparatus.

2. The recording medium conveying device according to claim 1, wherein the first conveying roller and the second conveying roller are selectively driven based on a forward or a reverse rotation of the driving means.

3. The recording medium conveying device according to claim 1, further comprising a third conveying roller, wherein the third conveying roller is located upstream from the first conveying roller and the second conveying roller and is configured to be driven by the driving means.

4. The recording medium conveying device according to claim 1, further comprising engaging means configured to engage and disengage the knob with and from the first conveying roller;

wherein the knob is configured to be disengaged from the first conveying roller in the case where the transfer conveying unit is removed from the main body of the image forming apparatus.

5. The recording medium conveying device according to claim 4, wherein an elastic member is located between the engaging means and the knob.

6. The recording medium conveying device according to claim 1, wherein the knob and the registration roller are connected to each other by transmitting means, and the registration roller rotates in response to movement of the knob.

7. An image forming apparatus comprising:

a recording medium storage section that stores a recording medium;

a recording medium conveying device that conveys the recording medium;

an image forming section that forms an image; and a recording medium discharging section to which the recording medium is discharged, the recording medium conveying device includes a first conveying means configured to feed the recording medium from the recording medium storage section to a registration roller, the recording medium storage section being located in a main body of the image forming apparatus, the first conveying means including a first conveying roller; and a second conveying means configured to feed the recording medium from a bypass tray to the registration roller, the second conveying means including a second conveying roller; and a transfer conveying unit including at least one side plate the registration roller, transfer means, and a knob for manually rotating the first conveying roller and the second conveying roller, the registration roller, transfer means and knob being supported by the at least one side plate;

wherein the first conveying roller and the second conveying roller are configured to be driven by a same driving means;

wherein the transfer conveying unit is capable of being removably mounted to the main body of the image forming apparatus by moving the at least one side plate out of the image forming apparatus; and wherein the first conveying means and the second conveying means are configured to remain fixed to the main body of the image forming apparatus in a case where the transfer conveying unit is removed from the main body of the image forming apparatus.

8. A conveyor device comprising:

a first conveyor configured to feed a recording medium from a recording medium storage section to a registration roller, the recording medium storage section being located in an image forming apparatus, the first conveyor including a first conveying roller;

a second conveyor configured to feed the recording medium from a bypass tray to the registration roller, the second conveyor including a second conveying roller; and a transfer conveying unit including at least one side plate, the registration roller, transfer means, and a knob for manually rotating the first conveying roller and the second conveying roller, the registration roller, transfer means and knob being supported by the at least one side plate;

wherein the first conveying roller and the second conveying roller are configured to be driven by a same driving means;

wherein the transfer conveying unit is capable of being removably mounted to the main body of the image forming apparatus by moving the at least one side plate out of the image forming apparatus; and wherein the first conveyor and the second conveyor are configured to remain fixed to the main body of the image forming apparatus in a case where the transfer conveying unit is removed from the main body of the image forming apparatus.

* * * * *